US005310362A

United States Patent [19]

Bäuerle et al.

[11] Patent Number: 5,310,362

[45] Date of Patent: May 10, 1994

[54] PIN-AND-SOCKET CONNECTOR

[75] Inventors: Gerhard Bäuerle, Obersulm-Willsbach; Claus Dullin, Ilsfeld-Wüstenhausen, both of Fed. Rep. of Germany

[73] Assignee: Amphenol-Tuchel Electronics GmbH, Heilbronn, Fed. Rep. of Germany

[21] Appl. No.: 65,532

[22] Filed: May 21, 1993

[30] Foreign Application Priority Data

May 23, 1992 [DE] Fed. Rep. of Germany ..... 4217205

[51] Int. Cl.[5] ..... H01R 13/66

[52] U.S. Cl. ..... 439/620; 439/497

[58] Field of Search ..... 439/15, 497, 620

[56] References Cited

U.S. PATENT DOCUMENTS

| | | | |
|---|---|---|---|
| 3,691,509 | 9/1972 | Krol | 439/497 X |
| 4,109,992 | 8/1978 | Hughes et al. | 439/620 |
| 4,412,715 | 11/1983 | Bogese | 439/620 X |
| 5,244,410 | 9/1993 | Demus et al. | 439/497 |

*Primary Examiner*—Eugene F. Desmond

*Attorney, Agent, or Firm*—John F. A. Earley; John F. A. Earley, III

[57] ABSTRACT

The present invention pertains to a pin-and-socket connector for accommodating and electrically contacting the strip conductors of a flat conductor flat cable with corresponding plug contacts via the intermediary of an electrical component.

The component is connected directly to one of the strip conductors of the flat conductor flat cable.

13 Claims, 1 Drawing Sheet

PIN-AND-SOCKET CONNECTOR

Figure 1:
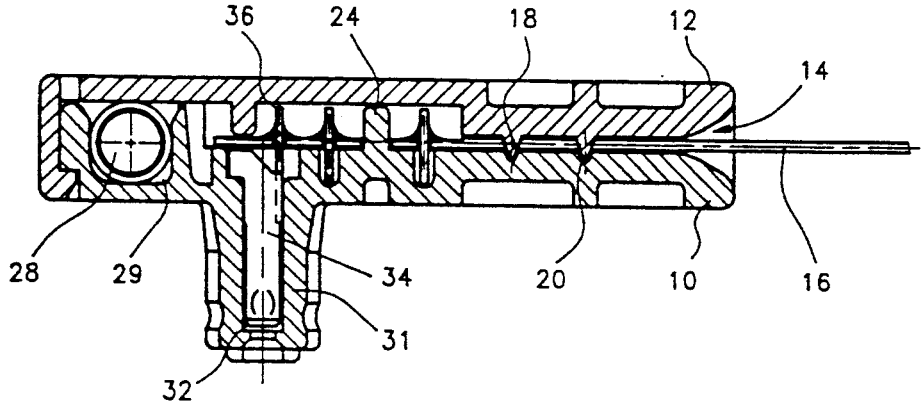

The present invention pertains to a pin-and-socket connector for accommodating and electrically contacting the strip conductors of a flat conductor flat cable, wherein an electrical component is connected to at least one strip conductor, and the number of plug contacts of the said electrical component, which are positioned in the pin-and-socket connector, corresponds to the number of strip conductors.

Such a pin-and-socket connector has been known from practice. The electrical component is connected with one of its arms to a strip conductor, while the other arm of the component leads to a separate contact point outside the flat conductor flat cable, and this contact point is separately connected to the strip conductor that belongs to it.

The prior-art pin-and-socket connector is used for the electrical connection of an "air bag," as is frequently used currently in motor vehicles. Especially when the air bag is arranged in the steering wheel, only very little space is available for accommodating the air bag as well as its connection parts. Space-saving design of the electrical connection elements is therefore important as well. The transition from a standard round cable to a flat conductor flat cable, which, wound up in a helical form, occupies relatively little space and is also able to follow the movements of the steering wheel, already leads to considerable progress in this connection. However, it is disadvantageous in the prior-art design that the pin-and-socket connector is relatively large and requires separate contact points for connecting the integrated electrical components.

Such an electrical component is, e.g., a "VHF" choke, i.e., an HF shielding choke for shielding against interfering electromagnetic radiation. Such a shielding component is important for eliminating faulty switching caused by external effects.

Thus, the basic task of the present invention is to provide a pin-and-socket connector of the class described in the introduction, which has the most compact and simple design possible and guarantees reliable HF shielding.

The present invention is based on the finding that this goal can be accomplished even without separate contact points outside the strip conductors of the flat conductor flat cable by interrupting the flat conductor flat cable between the two contact points with the electrical component. One contact point can thus be arranged in front of the interruption of the strip conductor, and the other contact point can be arranged behind the interruption, as a result of which an extremely compact and simple possibility is obtained for the electrical connection of the component. Separate contact points are eliminated.

If the terms "in front of" and "behind" the interruption are used, they are related to the direction of plugging in of the flat conductor flat cable into the pin-and-socket connector.

In its most general embodiment, the present invention pertains to a pin-and-socket connector of the class described in the introduction, with the following characteristics:

The pin-and-socket connector has a slot-like opening for accommodating and fixing the flat conductor flat cable;

at least one strip conductor is interrupted along its path in the pin-and-socket connector;

in front of the interruption, the strip conductor has a contact point, to which one arm of the component is electrically connected;

the other arm of the component is located behind the interruption at another contact point of the strip conductor;

additional openings for accommodating and fixing the plug contacts, which contact the corresponding strip conductors behind the interruption with their ends facing the flat conductor flat cable, are provided in the pin-and-socket connector.

Even though the geometric association of the strip conductors, on the one hand, and of the plug contacts, on the other hand, may be, in principle, any random association, a particularly compact design and a simple possibility of connection is obtained when the plug contacts extend approximately at right angles to the strip conductors. However, the present invention is not subject to any limitations in this respect.

In the simplest case, the said interruption is formed by a punched-out opening in the form of a window. Due to a window being punched out, the flat conductor flat cable becomes a kind of "printed circuit" for the connection of the electrical component, e.g., a VHF choke.

The electrical component may be arranged, in a space-saving manner—in extension of the flat conductor flat cable—in the pin-and-socket connector, so that only its arms lead to the corresponding contact points. This also permits a particularly compact design to be obtained.

In order not to provide two electrical connections at one contact point, e.g., for safety reasons, another embodiment of the present invention suggests that the plug contacts be connected electrically to the corresponding strip conductors via separate contact points.

On the whole, this results, in the case of a flat conductor flat cable with two strip conductors as well as two plug contacts, in four contact points, namely, two for connecting the electrical component and two more for contacting the strip conductors with the plug contacts.

The plug contacts consist of, e.g., contact springs and have, on their rear side, a laterally offset soldering pin, which compensates the grid difference of the contact paths and the contact springs by plugging these in rotated by 180°. It is possible to connect both soldering pins centrally in the contact path of the corresponding flat conductor with only one spring lead. The contact points are preferably formed by soldered joints.

To fix the flat conductor flat cable optimally in the pin-and-socket connector, the latter is designed as a two-part insulator body according to one embodiment of the present invention. One of the corresponding surfaces of the two insulator body halves has prongs (tips) projecting in the direction of the adjacent surface, which pierce the flat conductor flat cable in the insulation area between the strip conductors and penetrate into corresponding openings of the adjacent surface of the second insulator body. They may be, e.g., locked there by providing the prongs and openings with corresponding undercuts.

However, as an alternative or in addition hereto, the insulator body halves may also be locked with one another via (prior-art) pin-and-slot connections (snap connections).

Further characteristics of the present invention will become apparent from the characteristics of the subclaims as well as the other application documents.

The present invention will be explained in greater detail below on the basis of an exemplary embodiment.

Figure 2:
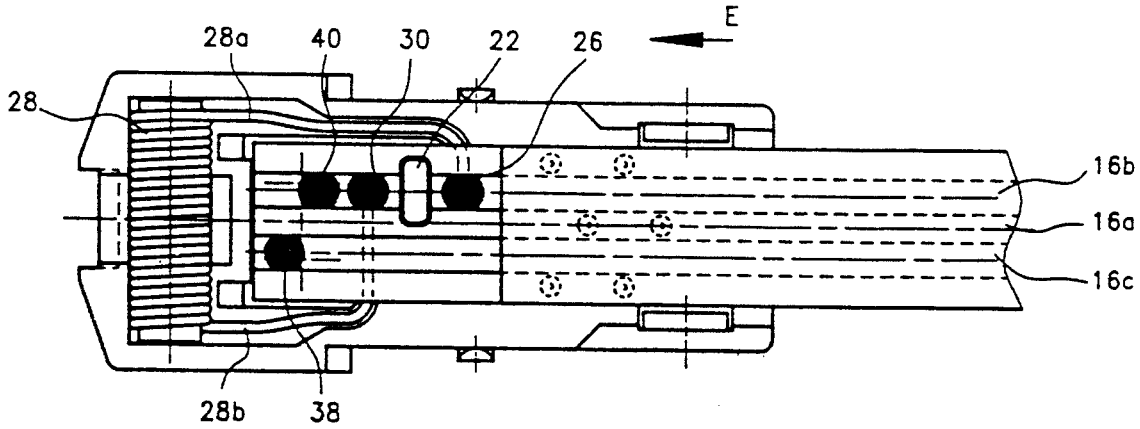

In schematic representations, FIG. 1 shows a vertical section through a pin-and-socket connector according to the present invention and FIG. 2 shows a top view of the (opened) pin-and-socket connector according to FIG. 1.

The pin-and-socket connector consists essentially of a lower insulating tray 10 and an upper insulating tray 12, which is locked together with it, and which [trays] form between them a slot-like opening 14 in the horizontal direction in FIG. 1, and a flat conductor flat cable 16 (hereinafter called cable) is located in the said opening.

To position the said cable 16, the said upper insulating tray 12 has downwardly projecting prongs 18. The said prongs 18 pierce an insulation area 16*a* between two strip conductors 16*b, c* of the said cable 16, and engage corresponding openings 20 of the said lower insulating tray 10 on the underside.

As is shown by a synopsis of FIGS. 1 and 2, the said strip conductor 16*a* is interrupted by a punched-out opening 22 at its free end zone. An upwardly projecting pin 24 of the said lower insulating tray 10 passes through the said punched-out opening 22, as a result of which an additional fixation of the said cable 16 is achieved.

A first contact point 26, to which an arm 28*a* of a VHF choke 28 is electrically connected, is recognizable in the area of the said strip conductor 16*b* immediately in front of the said punched-out opening (the window) 22, in the plugging-in direction (arrow E) of the said cable 16. The said choke 28 is located behind the said cable 16, in the direction of arrow E, in a bead-like depression 29 of the said insulator body. The second arm 28*b* of the said choke 28 extends from the opposite end back to the said strip conductor 16*b* under the said cable 16. However, the said arm 28*b* is connected there behind the said opening 22 to a corresponding contact point 30.

Under the free end of the said cable 16, the pin-and-socket connector has an extension 31, which contains two cylindrical openings 32, in which corresponding spring contacts 34 are located.

The said two contact springs 34 have, on their rear side, a laterally offset soldering pin 36, which equalizes the grid difference of the said contact paths 16*b, c* and the said contact springs 34 due to these being plugged in rotated by 180° in relation to one another here. It is thus possible to connect both said soldering pins 36 centrally to the corresponding contact path 16*b*, 16*c* of the said cable 16 via corresponding contact points 38, 40 with only one spring lead.

As is apparent from FIG. 2, the said contact points 30 and 40 are arranged behind the said punched-out opening 22.

A synopsis of FIGS. 1 and 2 shows that a highly compact design, in which separate connection points are not used for the said VHF choke 28, and which can be directly contacted with the said strip conductor 16*b* of the said cable 16, can be obtained with the design described.

The said plug contacts 34 also extend directly away from the said strip conductors 16*b, c* in the downward direction, as a result of which the width of the pin-and-socket connector is reduced to a minimum.

We claim:

1. Pin-and-socket connector for accommodating and electrically contacting the strip conductors (16*b, c*) of a flat conductor flat cable (16), wherein an electrical component (28) is connected to at least one strip conductor (16*b*), with a number of plug contacts (34) corresponding to the number of strip conductors (16*b, c*), which are positioned in the pin-and-socket connector, possessing the following characteristics:

1.1. a slot-like opening (14) for accommodating and fixing the flat conductor flat cable (16), wherein 1.2. at least one strip conductor (16*b*) is interrupted along its path in the pin-and-socket connector, 1.3.1. the strip conductor has a contact point (26), to which one arm (28*a*) of the component (28) is electrically connected, in front of the interruption (22), viewed in the plugging-in direction (E), 1.3.2. the other arm (28*b*) of the component (28) is in contact with another contact point (30) of the strip conductor (16*b*) behind the interruption (22), 1.4. additional openings (32) for accommodating and fixing the plug contacts (34), which contact the corresponding strip conductors (16*b, c*) behind the interruption (22) with their end facing the flat conductor flat cable (16), are provided in the pin-and-socket connector.

2. Pin-and-socket connector in accordance with claim 1, in which the interruption (22) is formed by a punched-out opening.

3. Pin-and-socket connector in accordance with claim 1, in which the component (28) is located in the pin-and-socket connector outside the area of the flat conductor flat cable (16) and of the plug contacts (34).

4. Pin-and-socket connector in accordance with claim 1, in which the plug contacts (34) are electrically connected to the corresponding strip conductors (16*b, c*) via separate contact points (38, 40).

5. Pin-and-socket connector in accordance with claim 1, in which the contact points (26, 30, 38, 40) are formed by soldered joints.

6. Pin-and-socket connector in accordance with claim 1, with a two-part insulator body (10, 12), in which one of the corresponding surfaces of the two insulator body halves (10, 12) has prongs (18) projecting in the direction of the adjacent surface, which pierce the flat conductor flat cable (16) in the insulating area (16*a*) between the strip conductors (16*b, c*) and enter corresponding openings (20) of the adjacent surface.

7. Pin-and-socket connector in accordance with claim 6, in which the prongs (18) have undercuts for locking in the correspondingly designed openings (20).

8. Pin-and-socket connector in accordance with claim 6, in which the insulator body halves (10, 12) are connected to one another via pin-and-slot connections.

9. Pin-and-socket connector in accordance with claim 1, in which the plug contacts (34) are arranged at an angle of about 90° to the longitudinal extension of the strip conductors (16*b, c*).

10. Pin-and-socket connector in accordance with claim 1, in which the plug contacts (34) have, at their end contacting the strip conductors (16*b, c*), a laterally soldering pin each, which equalizes the grid difference of the strip conductors (16*b, c*) and the plug contacts (34) due to these being inserted offset by 180° in relation to one another.

11. Pin-and-socket connector in accordance with claim 1, in which the plug contacts (34) consist of contact springs.

12. Pin-and-socket connector in accordance with claim 1, in which the electrical component (28) consists of an HF shielding choke.

13. Pin-and-socket connector for accommodating and electrically contacting the strip conductors (16*b, c*) of a flat conductor flat cable (16), wherein an electrical component (28) is connected to at least one strip conductor (16*b*), with a number of plug contacts (34) corresponding to the number of strip conductors (16*b, c*), which are positioned in the pin-and-socket connector, possessing the following characteristics:

a slot-like opening (14) for accommodating and fixing the flat conductor flat cable (16), wherein at least one strip conductor (16*b*) is interrupted along its path in the pin-and-socket connector, the strip conductor has a contact point (26), to which one arm (28*a*) of the component (28) is electrically connected, in front of the interruption (22), viewed in the plugging-in direction (E), the other arm (28*b*) of the component (28) is in contact with another contact point (30) of the strip conductor (16*b*) behind the interruption (22), and additional openings (32) for accommodating and fixing the plug contacts (34), which contact the corresponding strip conductors (16*b, c*) behind the interruption (22) with their end facing the flat conductor flat cable (16), are provided in the pin-and-socket connector, in which the interruption (22) is formed by a punched-out opening, in which the component (28) is located in the pin-and-socket connector outside the area of the flat conductor flat cable (16) and of the plug contacts (34), in which the plug contacts (34) are electrically connected to the corresponding strip conductors (16*b, c*) via separate contact points (38, 40), in which the contact points (26, 30, 38, 40) are formed by soldered joints, with a two-part insulator body (10, 12), in which one of the corresponding surfaces of the two insulator body halves (10, 12) has prongs (18) projecting in the direction of the adjacent surface, which pierce the flat conductor flat cable (16) in the insulating area (16*a*) between the strip conductors (16*b, c*) and enter corresponding openings (20) of the adjacent surface, in which the prongs (18) have undercuts for locking in the correspondingly designed openings (20), in which the insulator body halves (10, 12) are connected to one another via pin-and-slot connections, in which the plug contacts (34) are arranged at an angle of about 90° to the longitudinal extension of the strip conductors (16*b, c*), in which the plug contacts (34) have, at their end contacting the strip conductors (16*b, c*), a laterally offset soldering pin each, which equalizes the grid difference of the strip conductors (16*b, c*) and the plug contacts (34) due to these being inserted offset by 180° in relation to one another, in which the plug contacts (34) consist of contact springs, and in which the electrical component (28) consists of an HF shielding choke.

* * * * *